United States Patent [19]

Miller

[11] 4,387,766

[45] Jun. 14, 1983

[54] HOT OIL HEATER WITH HELICAL COIL BAFFLE

[75] Inventor: John H. Miller, Youngstown, Ohio

[73] Assignee: Hy-Way Heat Systems, Inc., Youngstown, Ohio

[21] Appl. No.: 226,893

[22] Filed: Jan. 21, 1981

Related U.S. Application Data

[62] Division of Ser. No. 89,255, Oct. 29, 1979, Pat. No. 4,299,194.

[51] Int. Cl.[3] ..... F28D 7/02; F28F 9/00

[52] U.S. Cl. ..... 165/172; 165/160; 165/162; 165/163; 165/164

[58] Field of Search ..... 165/162, 163, 164, 160, 165/172, 161, 169, 168

[56] References Cited

U.S. PATENT DOCUMENTS

| | | | |
|---|---|---|---|
| 1,162,537 | 11/1915 | Yager | 165/164 |
| 2,074,365 | 3/1937 | Clifford | 165/168 X |
| 2,143,287 | 1/1939 | Smith | 165/163 |
| 2,507,387 | 5/1950 | Sticelber | 165/162 X |
| 2,932,490 | 4/1960 | Olander | 165/163 X |
| 3,271,935 | 9/1966 | Smith | 165/163 X |
| 3,746,084 | 7/1973 | Ostbo | 165/163 |
| 3,962,999 | 6/1976 | Rehm | 165/163 X |
| 4,143,816 | 3/1979 | Skadeland | 165/163 X |
| 4,208,988 | 6/1980 | Jacobs et al. | 165/172 X |
| 4,314,397 | 2/1982 | Goolsby et al. | 165/163 X |

*Primary Examiner*—Sheldon J. Richter

*Attorney, Agent, or Firm*—Harpman & Harpman

[57] ABSTRACT

A helical coil of tubing is disposed in a cylindrical tank in spaced relation thereto so as to act as a baffle for the products of combustion introduced thereinto by creating a tortuous passageway in said tank. The helical coil has its end portions arranged in spaced parallel sections defining supporting skids extending longitudinally of the helical coil and thereby supporting the same in said tank. The tank is positioned in a secondary larger cylindrical tank and the fluid to be heated, such as oil, is circulated through the helical coil, the skid-like parallel communicating portions thereof forming the supports and in the area between the tanks to obtain a highly efficient heat transfer.

5 Claims, 4 Drawing Figures

HOT OIL HEATER WITH HELICAL COIL BAFFLE

This is a division of Ser. No. 089,255 filed Oct. 29, 1979 now U.S. Pat. No. 4,299,194 issued Nov. 10, 1981.

BACKGROUND OF THE INVENTION (1) Field of the Invention

This invention relates to hot oil heaters and the like of the type normally employed to heat oil or another liquid from a heat source such as an oil or a gas burner.

(2) Description of the Prior Art

Hot oil heaters and similarly formed liquid heaters or steam generators may be seen in U.S. Pat. Nos. 3,060,905; 3,962,999 and 4,041,908. In each of these patents helical coils of tubing are disposed in enclosures into which the products of combustion are introduced so as to obtain a heat transfer to the liquid circulated in the helical coil.

In the present invention, a helical coil is used as a tubular baffle disposed within a cylindrical tank, with the products of combustion being directed into and through the helical coil and diverted thereby throughout the interior of the cylindrical tank. The tank is located within a second tank of larger size and the fluid to be heated is positioned in the larger tank around the exterior of the inner tank and is circulated through the helical coil which forms the baffle in the inner tank. The helical coil and its end sections are formed in a unit so that the end sections which provide the means of communication with the helical coil itself are arranged in spaced parallel tubular members positioned longitudinally of the helical coil so as to support the same in the manner of skids and at the same time form spacing means for the helical coil with respect to the tank in which it is positioned. No prior art is known wherein a unitary self-contained helical coil is arranged in a baffle with parts of its structure forming spacing and supporting skid-like structures which space the same with respect to the interior of a chamber or a tank in which it may be located.

SUMMARY OF THE INVENTION

A hot oil heater comprises a pair of tanks, one within the other, so as to define a chamber for the liquid to be heated with a baffle formed of a helical tubular coil disposed in spaced relation in the innermost tank and supported therein by spaced parallel tubular connections extending from the ends of the helical coil and spaced with respect to one another to support the helical coil in the inner tank and provide means of communication with the respective ends thereof so that a heat exchange fluid may be moved therethrough.

DESCRIPTION OF THE PREFERRED EMBODIMENT

The invention disclosed herein is essentially a helical heat exchange coil of tubing arranged in a hot oil heater or the like to form both a heat exchanger and a baffle for the products of combustion introduced into the heater.

Figure 1:
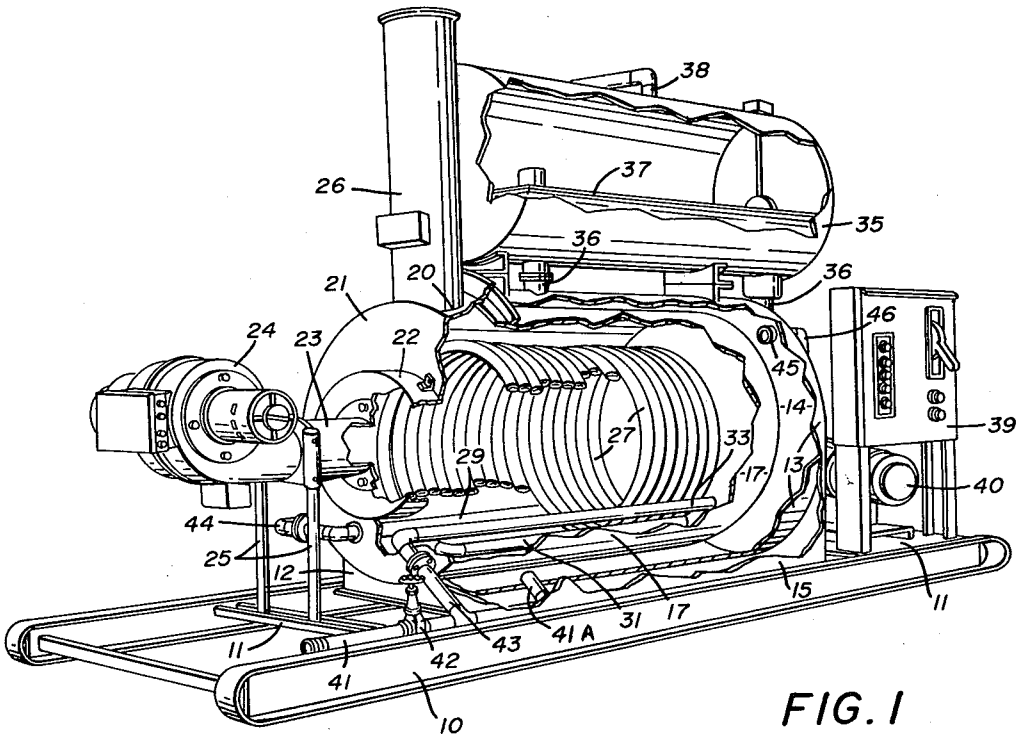
FIG. 1 is a perspective elevation of a hot oil heater with parts broken away and parts shown in cross section.
Figure 4:
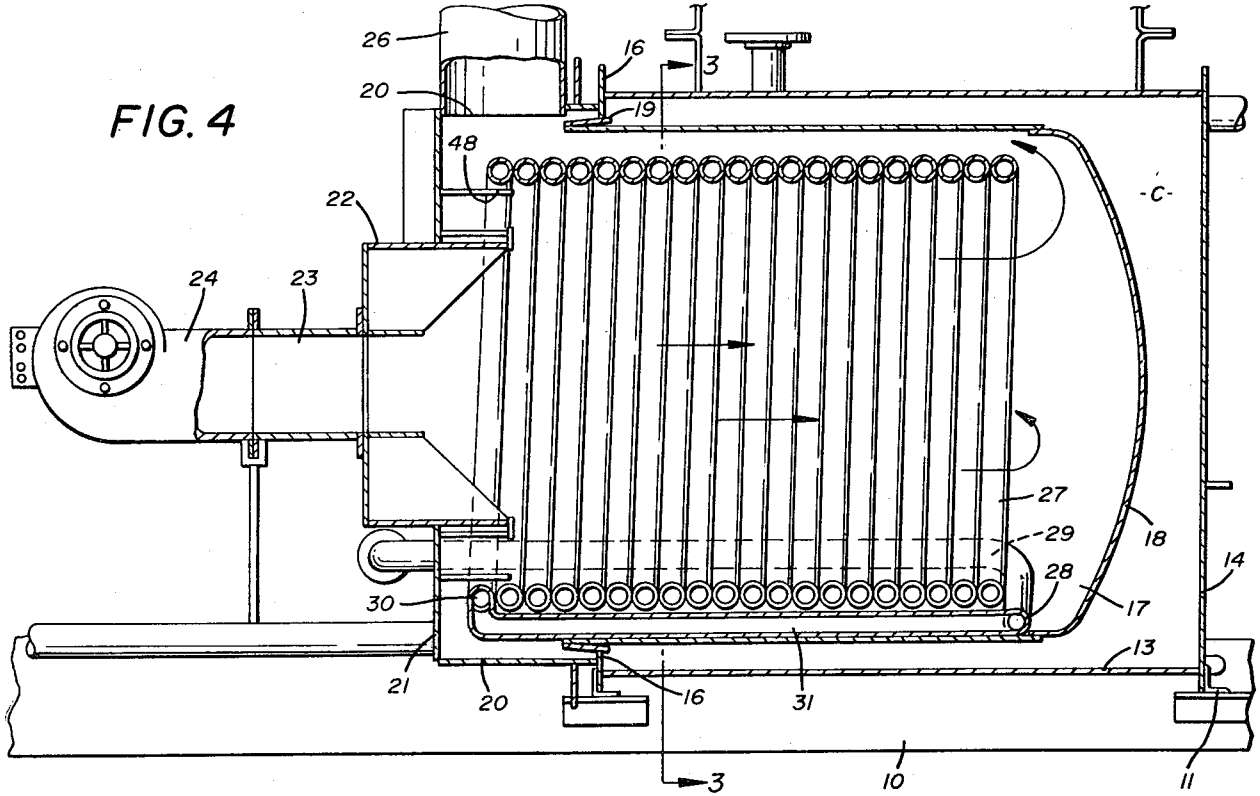
FIG. 4 is a vertical section with parts broken away illustrating the combustion path and heat exchange surfaces in the hot oil heater.

In FIG. 1 of the drawings, the hot oil heater will be seen to comprise a base skid frame 10 with transverse frame sections 11 together with several yokes 12 which support a tank 13 which is cylindrical and has a closed end wall 14. The tank 13 is supported on the base skid frame by additional side frame panels 15 and the end thereof opposite the end wall 14 is provided with an annular flange 16 that extends inwardly and outwardly as best seen in FIG. 4 of the drawings. As seen in FIG. 1, an inner tank 17 has an end wall 18 in spaced relation to the end wall 14 of the tank 13 and the cylindrical body of the inner tank 17 is open at its end opposite the end 18 and engaged in sealed relation in an angularly disposed annular flange 19 which in turn is supported on and held in sealed relation to the annular flange 16 which forms the front end wall of the tank 13.

As best seen in FIG. 4 of the drawings, the area between the inner tank 17 and the tank 13 forms a chamber C for oil or other fluid to be heated. A cylindrical extension joined to the angular flange 16 extends outwardly beyond the annular flange 16 and is provided with an end closure 21 which is apertured centrally to receive a combustion throat 22 to which an inlet member 23 is attached and which in turn receives the output portion of an oil burning device 24 which is supported on vertical supports 25 which extend upwardly from one of the frame members 11 heretofore referred to.

Referring again to FIGS. 1 and 4 of the drawings, it will be seen that a vent stack 26 is positioned on and in communication with the cylindrical extension 20. A helical coil of tubing 27 is disposed in the inner tank 17 in spaced relation to the cylindrical body thereof and the end 18 thereof. The convolutions of the coil of tubing 27 engage one another.

Figure 2:
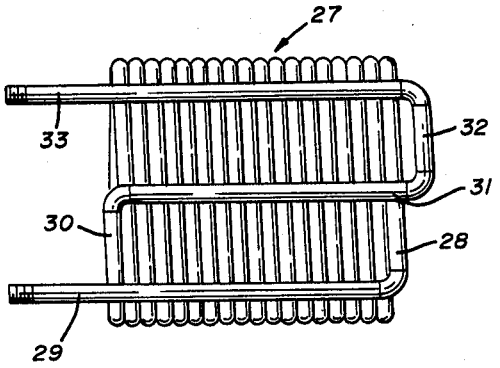
FIG. 2 is a bottom elevation of a tubular helical coil baffle showing the end connections thereof arranged in spaced parallel skid-like supports.

In FIG. 2 of the drawings, one end of the helical coil 27 is indicated by the numeral 28 and a communicating tubular extension by the numeral 29. The other end of the helical coil 27 is indicated by the numeral 30 and a communicating tubular extension 31 is positioned in spaced parallel relation to the communicating tubular extension 29 and extends toward the opposite end of the helical coil 27. A transverse section 32 continues the tubular extension 31 and communicates with a third tubular extension 33, which is also arranged in spaced parallel relation to the first mentioned tubular extension 29 and the second mentioned tubular extension 31.

Figure 3:
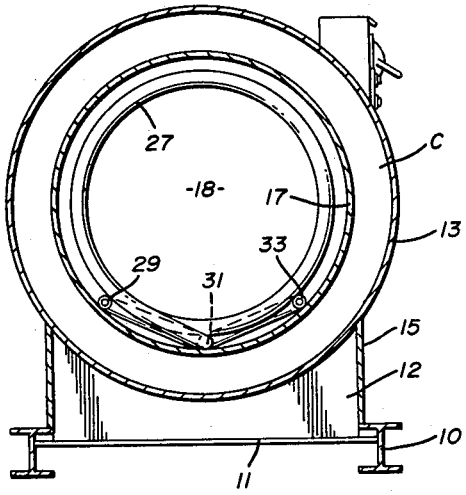
FIG. 3 is a cross sectional end elevation of a hot oil heater showing the helical tubular coil baffle and its skid-like support end extensions positioned therein.

As seen in FIGS. 1 and 3 of the drawings, the three tubular extensions 29, 31 and 33 respectively are positioned immediately adjacent the convolutions of the helical coil 27 so that they become support means arranged in a skid-like pattern and thereby position the helical coil 27 in the cylindrical body of the inner tank 17.

By referring again to FIG. 1 of the drawings, it will be seen that as customary in hot oil heaters, a surge tank 35 is positioned on the tank 13 and communicates therewith by way of communicating tubular connections 36. Oil in the chamber C in the tank 13 can thus flow into the surge tank 35. In FIG. 1, a fluid level 37 of the oil in the surge tank 35 is indicated and a vent 38 to atmosphere is also illustrated. A control panel 39 is mounted on the base skid frame 10 and incorporates controls as for a circulating pump as will be understood by those skilled in the art. A pump is shown and indicated by the numeral 40, which is necessary to circulate oil or other fluid being heated in the device to heat exchangers in remote items to be heated, such as asphalt storage tanks, etc.

In FIG. 1 of the drawings, the oil or other fluid returning from the remote location communicates with an inlet pipe 41 controlled by a valve 42 and an extension 43 of the pipe 41 communicates directly with the helical heat exchange coil and baffle 27 by way of the tubular extension 33 heretofore referred to which forms one of the spacing supports for the helical coil 27. The oil then flows through the connection 32 back through the communicating tubular extensions 31 and into the end 30 of the helical coil 27 where it flows therethrough and emerges at the end 28 and into the communicating tubular extensions 29 which communicates with an outlet port 44 exteriorly of the hot oil heater as seen in FIG. 1 of the drawings.

An extension of the inlet line 41 extends to an inlet port 41A in the tank 13 and the heated oil from the chamber C flows out of the tank 13 through an outlet port 45 and into communicating piping 46 which joins the outlet port piping 44 and leads to the pump 40 heretofore referred to from whence the heated oil is delivered to the heat exchanger in the tank or other device to be heated, as will be understood by those skilled in the art.

OPERATION

By referring to FIGS. 1 and 2 of the drawings, it will be seen that when the oil burner 24 is operated and it may also be a gas burner, the flames and products of combustion are introduced into the interior of the helical combination heat exchange coil and baffle 27 and they will flow longitudinally therethrough as indicated by the arrows in FIG. 4 of the drawings and will largely flow out of the opposite open end of the helical coil 27 into the space defined by the end wall 18 of the inner tank 17 and the baffle effect of the helical coil 27 will then direct the products of combustion backwardly toward the burner although on the opposite side of the helical coil 27 and into the area in the end of the device communicating with the vent stack 26.

In FIG. 4 of the drawings, an annular short wall 48 will be seen positioned around the combustion throat and just within the diameter of the helical heat exchange coil and baffle 27 to insure that the products of combustion follow the above described route for the most effective heat exchange relation to the fluid in the device.

It will thus be seen that a very effective and extremely simple combination helical coil heat exchanger and baffle have been disclosed in an hot oil heater environment and wherein the combination coil and baffle takes the form of a helical coil of tubing having its end sections arranged in spaced parallel sections circumferentially spaced from one another so as to underlie and form supports for the helical coil itself as well as members spacing the same with respect to a tank in which it is positioned.

Those skilled in the art will observe that the formation of the heat exchanger as illustrated is very simple as the complete tank assemblies are arranged and assembled and the heat exchange coil and baffle unit simply slid into position through the end thereof into which the combustion throat and oil burner means are then installed and of equal importance is the fact that the combination heat exchanger coil and baffle 27 of the device can be readily removed and replaced or repaired in the field by simply opening up one end of the hot oil heater, withdrawing the heat exchanger coil and baffle and replacing it or repairing it and then returning it.

Although but one embodiment of the present invention has been illustrated and described, it will be apparent to those skilled in the art that various changes and modifications may be made therein without departing from the spirit of the invention and having thus described my invention.

What I claim is:

1. A horizontally disposed cylindrical shaped baffle for use in a heater and the like in which liquids are heated, said baffle comprising a single helical coil of tubing, the convolutions of which are vertically arranged in side by side engaging relation and having straight sections of tubing communicating with said helical coil of tubing at the opposite ends thereof and extending in spaced parallel relation to one another on the outer side of and in supporting relation to said engaging convolutions of tubing forming said helical coil.

2. The cylindrically shaped baffle of claim 1 and wherein the horizontal length of said cylindrical shaped baffle including the several convolutions of said coil of tubing is substantially equal to the outer diameter thereof.

3. The cylindrically shaped baffle of claim 1 and wherein the ends of the convolutions of said coil of tubing are on horizontal planes adjacent the lower portions of said coil and at least one of said ends is below the lower portion of said coil with at least one of said straight sections of tubing connecting with said one end being positioned below the lower portion of said coil.

4. The cylindrically shaped baffle of claim 1 and wherein said straight sections of tubing comprise three elongated sections arranged in spaced parallel relation to one another and a fourth short section connecting two of said elongation sections.

5. The cylindrically shaped baffle of claim 4 and wherein said elongated straight sections of tubing are longer than said cylindrically shaped baffle.

* * * * *